United States Patent [19]

Sato et al.

[11] 3,989,426

[45] Nov. 2, 1976

[54] VANE PUMP

[75] Inventors: Masayuki Sato, Hitachi; Fumio Fujisawa, Mito; Kenichi Kawashima, Hitachi, all of Japan

[73] Assignee: Hitachi, Ltd., Japan

[22] Filed: July 18, 1975

[21] Appl. No.: 597,176

[30] Foreign Application Priority Data

July 24, 1974 Japan ..... 49-84205

[52] U.S. Cl. ..... 418/138

[51] Int. Cl.[2] ..... F04C 29/10

[58] Field of Search ..... 418/137, 138, 241, 75, 418/77, 82

[56] References Cited

UNITED STATES PATENTS

| | | | |
|---|---|---|---|
| 2,070,138 | 2/1937 | Martin | 418/138 |
| 2,536,851 | 1/1951 | Latham | 418/138 |
| 3,072,068 | 1/1963 | Weiss | 418/138 |
| 3,187,678 | 6/1965 | Pettibone | 418/82 |
| 3,373,929 | 3/1968 | Partain | 418/138 |

*Primary Examiner*—C. J. Husar
*Assistant Examiner*—Leonard E. Smith
*Attorney, Agent, or Firm*—Craig & Antonelli

[57] ABSTRACT

A vane pump comprising a cylindrical pump chamber, vanes adapted to rotate within the pump chamber, and a drive rotor arranged eccentrically with respect to the center of rotation of the vanes, such vane pump being formed with through holes in portions of opposite end walls of the drive rotor which are in spaced juxtaposed relationship with side end faces of each vane, such through holes being connected to a line for supplying therethrough a portion of the fluid discharged by the vane pump. During operation of the vane pump, the portion of the fluid discharged by the pump and supplied through the line is ejected through the through openings against the side end faces of the vanes so as to avoid collision between the end walls of the drive rotor and the side end faces of the vanes whereby the service life of the vane pump can be increased.

10 Claims, 6 Drawing Figures

VANE PUMP

BACKGROUND OF THE INVENTION

This invention relates to pumps, and more particularly it deals with a vane pump.

Generally, a vane pump comprises a housing including a cylindrical pump chamber, a cylindrical drive rotor arranged eccentrically in the pump chamber and adapted to rotate such that it is disposed in close proximity to a portion of the inner wall surface of the pump chamber, and a plurality of vanes rotatably supported by a vane shaft arranged in the center axis of the pump chamber. The vane shaft is mounted to be disposed within the drive rotor while each vane extends outwardly of the drive rotor through one of slits formed in the cylindrical portion of the drive rotor, so that its outer end is disposed in the neighborhood of the inner wall surface of the pump chamber. In the pump constructed as aforesaid, the drive rotor rotates to cause the vanes to rotate so that the pumping action may be performed. The efficiency of the pump is greatly influenced by the airtight sealing effect provided between the vanes and the drive rotor.

The vanes each extend outwardly through one of the slits formed in the cylindrical portion of the drive rotor. Portions in which airtight seal must be provided are between each slit and opposite surfaces of one of the vanes and between the end walls at the opposite side ends of the cylindrical portion of the drive rotor and the opposite end faces of each vane. A sealing material is generally mounted between each slit and opposite surfaces of one of the vanes. However, no sealing material is provided between the side end faces of each vane and the end walls of the drive rotor. By minimizing the clearance between them, these portions are substantially sealed.

Forces which are complicated act on the vanes and the vane shaft supporting the vanes during rotation of the vanes and the drive rotor. As a result, the vanes may move axially of the vane shaft and the side end faces of the vanes may be brought into collision with one of the end walls of the drive rotor. The vanes move in complicated swinging motion relative to the end walls of the drive rotor. Thus, if the side end faces of the vanes are in contact with one of the end walls of the drive rotor, the vanes and the drive rotor will move in sliding swinging motion relative to one another. This sliding swinging motion will cause wear to the respective sliding surfaces, so that the clearance between the end faces of the vanes and the end walls of the drive rotor will increase and the volume of fluid discharged by the pump will decrease.

This sliding swinging motion increases in magnitude as the number of revolutions of the vanes increase, with an attendant increase in the wear caused to the sliding surfaces. In a vane pump which is operated at high speeds as is usually the case nowadays, the sliding surfaces of the vanes and the drive rotor wear off quickly, so that the vane pump has a short service life. In case the vanes are fabricated by cutting a plate formed by connecting together glass fibers with a phenol resin as is usually done nowadays, the glass fibers tend to be broken at the cut and converted into particles which find their way between the sliding surfaces of the vanes and the drive rotor. This promotes wear of the sliding surfaces of the vanes and the drive rotor, thereby further reducing the durability of the pump.

SUMMARY OF THE INVENTION

An object of the present invention is to provide a vane pump provided with means for avoiding wear of the side end faces of the vanes and the end walls of the drive rotor to thereby prevent a reduction in the volume of fluid discharged by the pump.

Another object of the invention is to provide a vane pump wherein collision of the side end faces of the vanes against the end walls of the drive rotor can be prevented.

Another object of the invention is to provide a vane pump wherein a fluid is ejected from the end walls of the rotor against the side end faces of the vanes, so that collision of the side end faces of the vanes against the end walls of the drive rotor can be prevented and these parts can be lubricated with the fluid.

Still another object of the invention is to provide a vane pump wherein a portion of the air discharged by the pump is ejected from the end walls of the drive rotor against the side end faces of the vanes, so that collision of the end faces of the vanes against the end walls of the drive rotor can be prevented and these parts can be lubricated with the fluid.

A further object of the invention is to provide a vane pump wherein a portion of the air discharged by the pump is ejected from the end walls of the drive rotor against the side end faces of the vanes, and wherein the air delivered into the drive rotor can be discharged therefrom through an axial bore formed in the vane shaft and/or an axial bore formed in the rotor shaft of the drive rotor so as to cool the interior of the drive rotor.

Additional and other objects and advantages of the invention will become evident from the description of the preferred embodiments of the invention set forth hereinafter when considered in conjunction with the accompanying drawings.

DETAILED DESCRIPTION OF THE PREFERRED EMBODIMENTS

Figure 1:
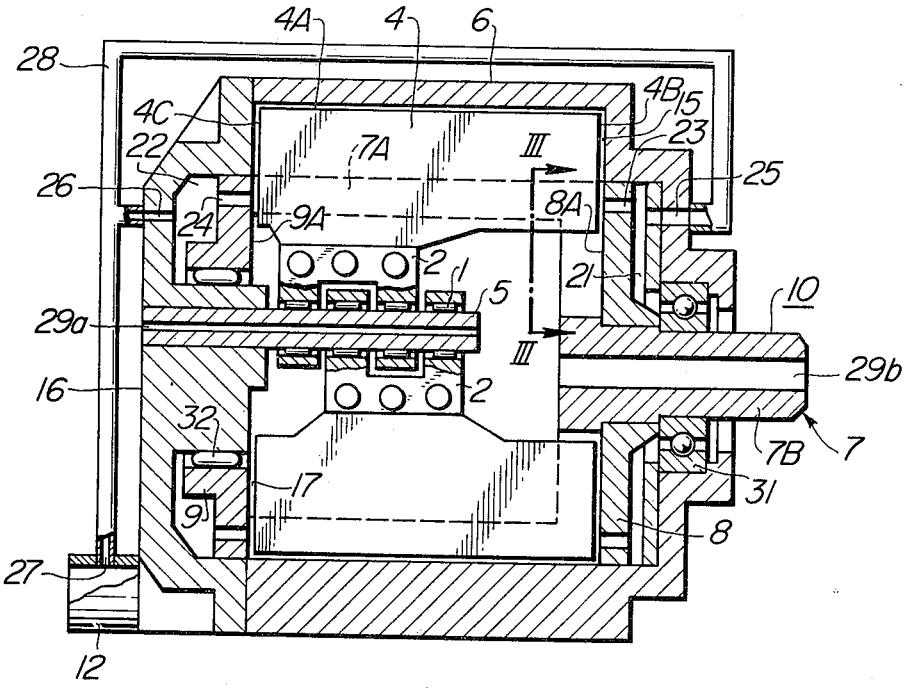
FIG. 1 is a vertical sectional view of the vane pump comprising one embodiment of the invention.
Figure 2:
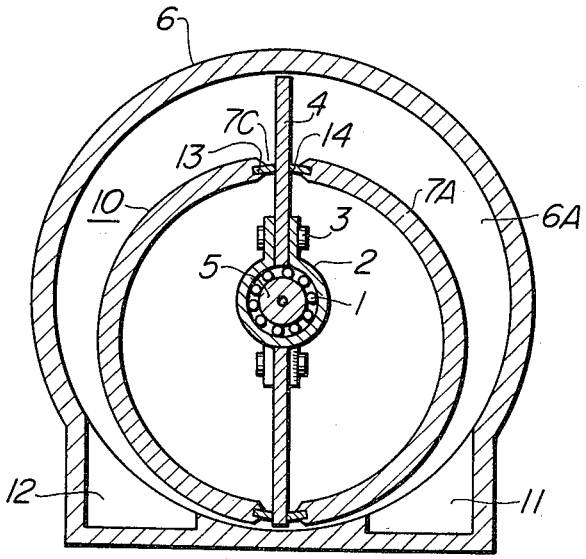
FIG. 2 is a sectional side view of the vane pump shown in FIG. 1.

FIG. 1 and FIG. 2 show an embodiment of the invention as applied to an oilless and non-contacting type vane pump. In FIG. 1 and FIG. 2, a housing 6 defines therein a cylindrical pump chamber 6A which is closed at one end by an end cover 16. Cylindrical side chambers 21 and 22 are provided at opposite sides of the pump chamber 6A and arranged eccentrically with respect to the pump chamber 6A.

A drive rotor 10 is rotatably supported by bearings 31 and 32 and disposed within the pump chamber 6A and side chambers 21 and 22. The drive rotor 10 comprises a rotor shaft 7 including a cylindrical portion 7A and a shaft portion 7B formed integrally with each other, a rotor bearing housing 9 attached to a forward end of the cylindrical portion 7A, and a keep plate 8 attached to a rear end of the cylindrical portion 7A. The drive rotor 10 is mounted such that the cylindrical portion 7A is disposed in the pump chamber 6A while the keep plate 8 and rotor bearing housing 9 are disposed in the side chambers 21 and 22 respectively. Inner surfaces 8A and 9A of the keep plate 8 and rotor bearing housing 9 respectively constitute end walls of the cylindrical portion 7A. As can be more clearly seen in FIG. 2, the cylindrical portion 7A is eccentric with respect to the pump chamber 6A and arranged such that the former is substantially in contact with an inner peripheral surface of a lower end of the pump chamber 6A. A suction port 11 and a discharge port 12 are formed on opposite sides of the inner surface of the lower end of the pump chamber 6A with which the cylindrical chamber 7A is maintained substantially in contact.

The end cover 16 supports a vane shaft 5 such that the latter is in alignment with the center axis of the pump chamber 6A. Supported by the vane shaft 5 through vane bearings 1 are vane housings 2 to which vanes 4 are affixed by rivets 3. The vanes 4 extend outwardly of the cylindrical portion 7A through slits 7C formed therein, so that an outer end of each vane 4 is disposed in the vicinity of the inner peripheral surface of the pump chamber 6A. More specifically, there is a very small clearance between an outer end 4A of each vane 4 and the inner peripheral surface of the pump chamber 6A. The slits 7C each have a length which is substantially the same as the width of the pump chamber 6A and are closed at opposite ends thereof by the end walls 8A and 9A. The vanes 4 each have a length which is slightly smaller than the length of the slits 7C and opposite side end faces 4B and 4C which are juxtaposed against the end walls 8A and 9A and spaced therefrom by clearances 15 and 17 respectively. A movable vane seal 13 and a fixed vane seal 14 are provided between each slit 7C and the respective vane 4.

Figure 3:
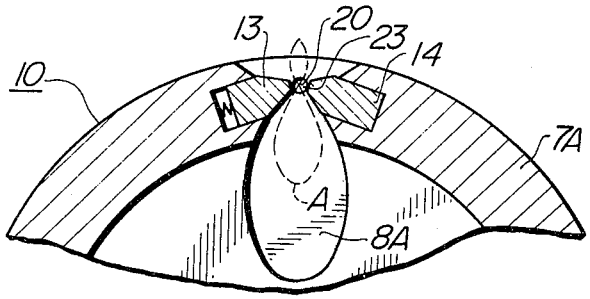
FIG. 3 is a sectional view as seen in the direction of arrows III—III of FIG. 1, with the vane being omitted.

The construction of the vane pump described above is publicly known. The vanes 4 are rotated by the drive rotor 10 about the vane shaft 5 to draw a fluid by suction through the suction port 11 and discharge the same through the discharge port 12. When the vane pump of the aforesaid construction is assembled, the vanes 4 are mounted on the vane shaft 5 such that the clearances 15 and 17 are formed on opposite side end faces thereof. However, as aforementioned, forces oriented axially of the vane shaft 5 act on the vanes 4 during rotation of the latter, so that the vanes are moved by these forces. Thus the side end face 4B or 4C of each vane 4 is brought into contact with the end wall 8A or 9A. As shown in FIG. 3, a point on the side end face 4B of the vane 4 moves as indicated by a dotted line A with respect to the end wall 8A during rotation of the vane 4. In case such movement occurs while the end face 4B of the vane 4 is being in contact with the end wall 8A, wear will be caused to the portions of the side end face 4B and end wall 8A which are in contact with each other.

According to the present invention, through holes 23 and 24 are formed respectively in the keep plate 8 and rotor bearing housing 9 which constitute the drive rotor 10 and open at the end walls 8A and 9A in positions where they face the respective vanes 4. As shown in FIG. 3, the through hole 23 is disposed at the point at which opposite ends of the locus A of the sliding movement of the vane 4 join or between the two seals 13 and 14, and has a diameter which is smaller than the width of the vane 4. Thus the open end of the through hole 23 is disposed in spaced juxtaposed relation with the side end face of the vane 4 at all times during rotation of the vane 4. The through holes 24 are arranged in the same manner as the through holes 23.

The housing 6 is formed therein with a duct 25 through which communication is maintained between the side chamber 21 and the outside, while the end cover 16 is formed therein with a duct 26 through which communication is maintained between the side chamber 22 and the outside. A line 28 is connected at one end thereof to the duct 25 formed in the housing 6 and at the other end to a branch port 27 formed on a lateral surface of the discharge port 12, with the line 28 communicating at its intermediate portion with the duct 26 formed in the end cover 16. Axial bores **29*a* and 29*b* are formed in the vane shaft 5 and rotor shaft 7** respectively to maintain communication between the interior of the pump and the outside.

In the vane pump constructed as aforesaid, rotation of the drive rotor 10 causes the vanes 4 to rotate about the vane shaft 5. Forces oriented axially of the vane shaft 5 act on the vanes 4 due to deflection of the vane shaft 5 caused by centrifugal forces acting on the vanes 4 and other causes. This causes the side end face 4B or 4C of each vane 4 to move toward the end wall 8A or 9A through the clearance 15 or 17, and the side end face 4B or 4C is almost brought into collision with the end wall 8A or 9A. If this is the case, a portion of the fluid discharged by the pump will be supplied through the branch port 27, line 28, duct 26 formed in the end cover 16 and the duct 25 formed in the housing 6 into the side chambers 21 and 22 from which the fluid passes through the through holes 23 and 24 to be ejected against the side end faces of the vanes, thereby preventing collision between the end faces of the vanes 4 and the end walls 8A and 9A.

The collision preventing action will be described with reference to FIG. 4. If the force exerted on the end face 4C by the fluid supplied through the branch port 27, the duct 26 in the end cover 16 and the through hole 24 formed in the rotor bearing housing 9 is denoted by P and if the force exerted on the end face 4B by the fluid supplied through the duct 25 formed in the housing 6 and the through hole 23 formed in the keep plate 8 is denoted by P′, the forces exerted on the opposite side end faces 4C and 4B will be equal to each other provided that the clearance 15 between the end face 4B of the vane 4 and the end wall 8A is equal in dimension to the clearance 17 between the end face 4C of the vane 4 and the end wall 9A, or $$P = P' \qquad 1.$$

Thus the vane 4 will be disposed in a neutral position.

Figure 4:
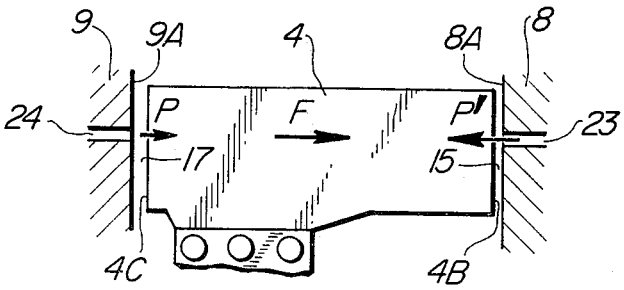
FIG. 4 is a view in explanation of the action of the discharged fluid.

If a thrust F acts on the vane 4, the vane 4 will be displaced toward the keep plate 8 as shown in FIG. 4. If this is the case, the forces exerted on the opposite side end faces of the vane will be $P' > P$, so that the vane 4 will move to a position in which the following relation holds:

$$F + P = P' \qquad 2.$$

When the thrust F is great in value and the following relation holds, $F > P' - P$ 3.

the vane 4 is brought into contact with the keep plate 8. However, the force exerted on the vane 4 which is F − P′ + P is smaller than that when the force F alone is exerted on the vane 4. Thus less wear is caused on the contact surfaces of the vane and the drive rotor.

In case the vanes 4 are fabricated by cutting a plate formed by connecting together glass fibers with a phenol resin, the glass fibers tend to be broken at the cut and converted into particles which find their way into the sliding surfaces, thereby promoting wear. The provision of the through holes 23 and 24 according to the invention has the effect of dispersing the particles by the fluid emitted through the through holes. The fluid emitted through the through holes 23 and 24 moves through the interior of the drive rotor 10 and is discharged through the axial bore 29*a* of the vane shaft 5 or the axial bore 29*b* of the rotor shaft 7B. The fluid thus has the effect of cooling the heated drive rotor 10.

Figure 5:
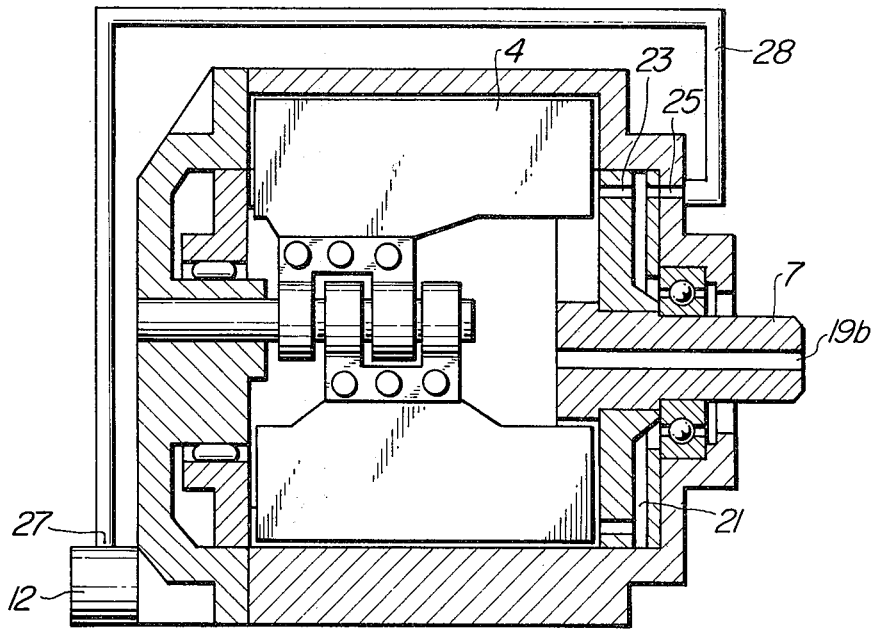
FIG. 5 and FIG. 6 are vertical sectional views of other embodiments of the invention.

Forces oriented axially of the vane shaft and acting on the vanes are very complicated in direction and magnitude and not constant at all times. For example, the forces vary depending on the shape of the vanes, the strength of the vane shaft and the type of vane bearings. Moreover, an error committed during manufacturing is responsible for variations in the forces. In a certain type of vane pumps, such forces act only in one direction at all times. FIG. 5 shows an embodiment of the invention in which the invention is applied to a vane pump wherein the forces acting on the vanes 4 are oriented in one direction only or rightwardly in FIG. 5. In this embodiment, the through holes 23 are only formed in the keep plate 8 because the forces acting on the vanes 4 are oriented rightwardly, the holes 23 opening at the end wall 8A thereof and maintained in communication with the side chamber 21 at the outside. The duct 25 formed in the housing 6 is maintained in communication with the side chamber 21 at one end and with the line 28 at the other end. By this arrangement, the right end face 4B of each vane 4 is advantageously kept from colliding with the end wall 8A by the fluid ejected through the respective through hole 23.

Figure 6:
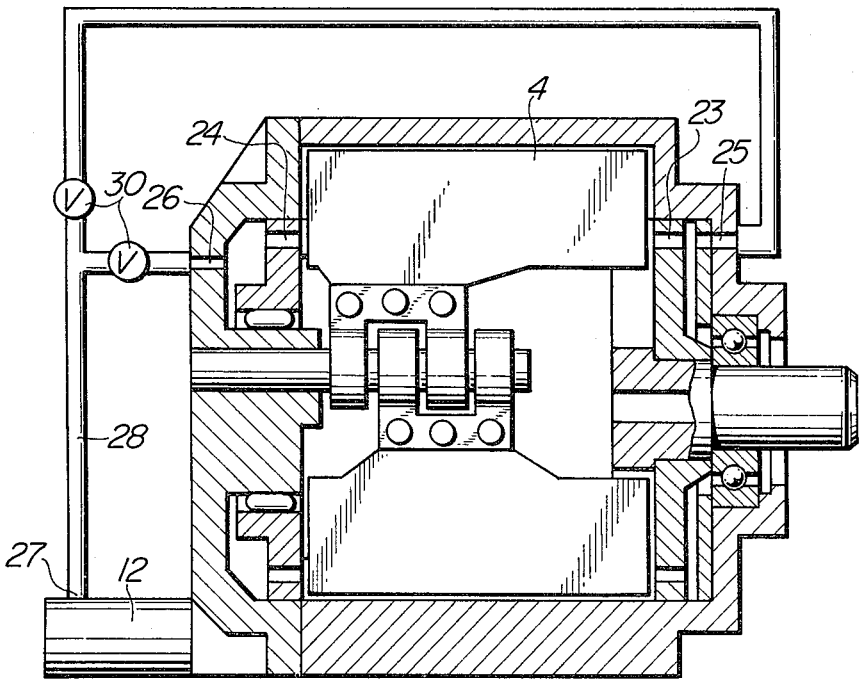

In the embodiment shown in FIG. 6, valves 30 are mounted in the line 28 connecting the branch port 27 to the duct 26 formed in the end cover 16 and the duct 25 formed in the housing 6. The forces P and P′ exerted by the fluid on the end faces 4C and 4B respectively of the vanes can be varied by adjusting these valves 30 so as to set the vanes 4 at a neutral position.

From the foregoing description, it will be appreciated that according to the present invention a portion of the fluid discharged by the pump can be made to act on the side end faces of the vanes to thereby prevent as much as possible collision between the side end faces of the vanes and the end walls of the drive rotor so that less wear may be caused thereto. At the same time, the invention enables to cool the interior of the drive rotor by the fluid and increase the durability of the pump.

We claim:

1. A vane pump comprising:

a housing defining a cylindrical pump chamber having closed ends;

a vane shaft supported at one of said closed ends and extending in said pump chamber in alignment with the center axis thereof;

a plurality of vanes rotatably supported by said vane shaft;

a drive rotor including a cylindrical portion, end walls disposed at opposite ends of the cylindrical portion, and a rotor shaft for supporting said drive rotor for rotation in said pump chamber, said cylindrical portion having axial slits through which said vanes extend, and said cylindrical portion being arranged eccentrically in said pump chamber;

a suction port and a discharge port, both of which are communicated with said pump chamber;

side chambers formed respectively between the end walls of said drive rotor and said closed ends of said housing;

conduit means for conducting fluid from said discharge port to the respective side chambers;

valve means installed in said conduit means for controlling flow of said fluid to said respective side chambers; and means formed through said end walls of said drive rotor for communicating said fluid between said respective side chambers and said pump chamber in locations always facing the side edge faces of said vanes.

2. A vane pump according to claim 1, wherein said means through said end walls are holes having diameters less than the thickness of said vanes.

3. A vane pump according to claim 1, wherein said vane shaft is formed with a bore by which the space inside said drive rotor is communicated with the atmosphere.

4. A vane pump according to claim 1, wherein said valve means installed in said conduit means includes two valves capable of independently controlling the flow of said fluid being supplied to said respective side chambers.

5. A vane pump according to claim 1, wherein said conduit means include two branch portions conducting said fluid separately to said respective side chambers, and wherein said valve means include a valve installed in each branch portion.

6. A vane pump according to claim 1, wherein at least one of said closed ends of said pump chamber is formed by an end cover of said housing, and wherein said vane shaft is supported for rotation by said end cover.

7. A vane pump according to claim 1, wherein said means formed through said end walls of said drive rotor are substantially in alignment with said axial slits of said cylindrical portion.

8. A vane pump according to claim 1, wherein said fluid is pressurized air.

9. A vane pump according to claim 1, wherein said valve means vary pressure of said fluid exerted on respective end walls of said drive rotor such that fluid pressure on the side edge faces of said vanes is controlled to position said vanes in said pump chamber.

10. A vane pump according to claim 9, wherein said conduit means include two branch portions conducting said fluid separately to said respective side chambers, and wherein said valve means include a valve installed in each branch portion.

* * * * *